US005921352A

United States Patent [19]

Garrido et al.

[11] Patent Number: 5,921,352

[45] Date of Patent: Jul. 13, 1999

[54] DEVICE FOR ENHANCING ELEVATOR ROPE TRACTION

[75] Inventors: Alfonso Garrido, Paris, France; José Sevilleja, Madrid, Spain

[73] Assignee: Otis Elevator Company, Farmington, Conn.

[21] Appl. No.: 08/926,098

[22] Filed: Sep. 9, 1997

[51] Int. Cl.[6] ..... B66B 11/08

[52] U.S. Cl. ..... 187/264

[58] Field of Search ..... 187/254, 264, 187/251

[56] References Cited

U.S. PATENT DOCUMENTS

| | | | |
|---|---|---|---|
| 4,620,615 | 11/1986 | Morris et al. | 187/264 |
| 5,186,283 | 2/1993 | Salmon | 187/254 |

FOREIGN PATENT DOCUMENTS

| | | | |
|---|---|---|---|
| 261347A1 | 10/1988 | German Dem. Rep. | 187/254 |
| 614477 | 6/1935 | Germany | 187/254 |
| 909986 | 4/1954 | Germany | 187/254 |
| 506566 | 3/1976 | U.S.S.R. | 187/264 |
| 700414 | 11/1979 | U.S.S.R. | 187/264 |

*Primary Examiner*—William E. Terrell
*Assistant Examiner*—Khoi H. Tran

[57] ABSTRACT

A traction drive elevator system includes a device to enhance the traction forces between the ropes as the traction sheave. As a result, the traction force is the sum of the traction force caused by the tension in the ropes and the traction force caused by the traction enhancement device.

10 Claims, 3 Drawing Sheets

DEVICE FOR ENHANCING ELEVATOR ROPE TRACTION

TECHNICAL FIELD

The present invention relates to elevator systems, and more particularly to elevator systems having traction ropes.

BACKGROUND OF THE PRESENT INVENTION

A typical traction elevator includes a car and counterweight connected together by a plurality of ropes. The ropes extend over a traction sheave that is engaged with a drive machine. As a result of traction between the ropes and sheave, rotation of the sheave by the drive machine causes the car and counterweight to move in opposite directions through the hoistway. The magnitude of the traction between the ropes and traction sheave is dependant upon the friction between the ropes and sheave, the length of contact between the ropes and sheave, and the tension in the ropes.

The friction between the ropes and sheave may be increased by changing the contour of the groove of the sheave. This, however, may lead to increased wear of the sheave and ropes. Another possibility is to place a liner in the groove to enhance the friction between the ropes and sheave. This configuration has been successfully used to increase traction while minimizing the wear of the ropes and the sheave. The liners wear, however, and require replacement.

The length of contact between the ropes and sheave may be varied to optimize the amount of traction. In a single wrap roping configuration, which is the most common type, the length of contact is less than 180 degrees. Various methods to increase the length of contact have been used, such as long-wrap configurations and double-wrap configurations. Both of these configurations increase the length of contact to beyond 180 degrees. A drawback to increasing the length of contact, however, is the increased amount wear of the rope and sheave.

The tension in the ropes is dependant upon the weight of the car and counterweight. The heavier the car, counterweight and ropes, the more traction is generated. Unfortunately, the traction forces generated on the ropes and sheave are not uniform. For the single wrap configuration, the maximum traction force occurs at the midpoint between the take-up point and the take-off point for the ropes, with the minimum traction occurring at those points. This non-uniform distribution of loads may result in peak loads that cause damage or excessive wear of the ropes and sheave.

In addition, heavier components also increase the load on the drive machine. In general, the trend is toward the use of lightweight materials to produce lightweight components and thereby reduce the loads and the size of the drive machines, brakes, etc. The reduction in weight is limited, however, by the need to generate sufficient traction to drive the car and counterweight.

The above art notwithstanding, scientists and engineers under the direction of Applicants' Assignee are working to develop traction elevator systems that minimize wear of the ropes and traction sheaves and permit the weight of the car and counterweight to be minimized.

DISCLOSURE OF THE INVENTION

According to the present invention, a traction drive elevator system includes means to enhance the traction forces between the ropes and the contact surfaces of the traction sheave. The enhancement means increases the contact pressure between the ropes and the contact surfaces over at least a portion of the contact surface, such that the resulting traction forces include the sum of the traction forces caused by the tension in the ropes and the traction forces caused by the enhancement means.

One of the advantages of the present invention is that the traction forces are not solely dependent upon the tension in the ropes. Therefore, lighter components may be used, such as lightweight cars, lightweight ropes and, correspondingly, lightweight counterweights. As a result, other system components may be optimized.

For instance, the drive machine may require less output and braking systems may be smaller because of the lightweight components.

According to a particular embodiment of the present invention, the enhancement means includes biasing means disposed proximate to the rope take-up position and take-off position. The biasing means increases the traction forces between the ropes and the sheave in these particular locations.

As a result of the specific embodiment, the distribution of traction forces about the contact surface of the sheave is more uniform. This feature of distributing the loads results in minimal wear of the ropes and sheave by avoiding or minimizing the peak in traction forces that is present in conventional traction drive systems and by minimizing the length of contact that is necessary between the ropes and sheave.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
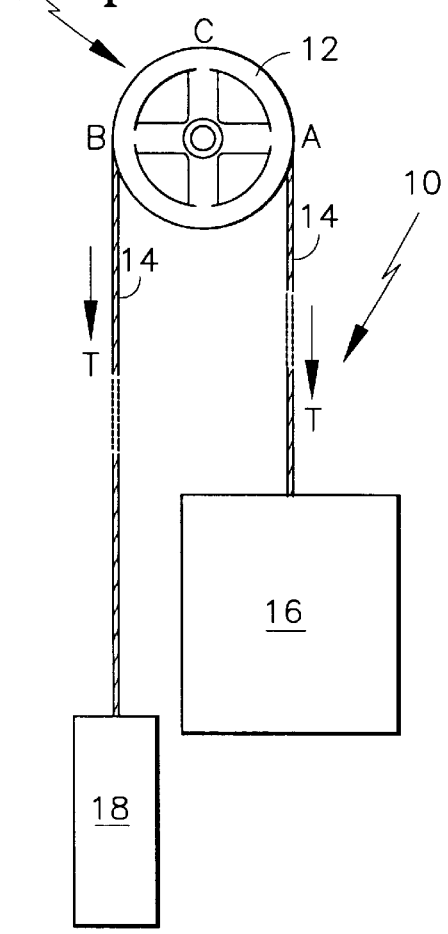
FIG.1 prior art
FIG. 1 is a side view of a prior art traction drive elevator system.

Illustrated schematically in FIG. 1 is a conventional traction drive 8 for an elevator system 10. This system 10 includes a traction sheave 12 driven by a machine (not shown) and engaged with a plurality of ropes 14 in a simple, single wrap configuration. The ropes 14 extend downward to a car 16 and a counterweight 18. The mass of the car 16 and counterweight 18 results in a tension T in each of the ropes 14. The traction force between the ropes 14 and the traction sheave 12 is dependant upon the tension T and upon the position of the ropes 14 on the sheave 12. This is illustrated graphically in FIG. 2. The forces generated by the tension T is minimal at the initial contact points of the ropes 14 with the sheave 12, i.e., the points where the ropes 14 initially engage the sheave 12 or where the ropes 14 and the sheave 12 separate, depending upon the direction of rotation of the sheave 12. These points are referred to hereinafter as the 'take-up' and 'take-off' positions and are shown in FIGS. 1 and 2 as positions A and B.

Figure 4:
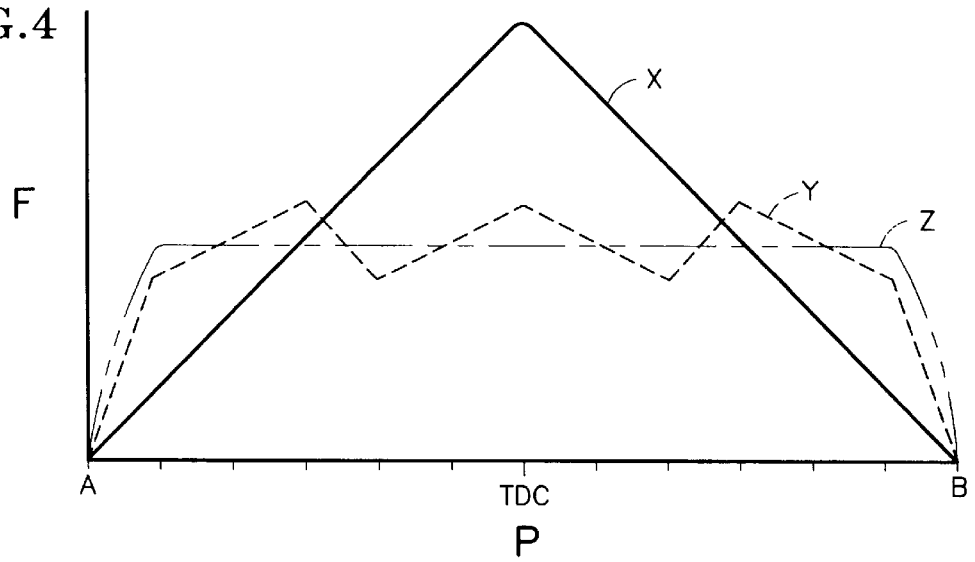
FIG. 4 is a graphical representation of the traction load distribution of various traction drive elevator systems.

As can be seen in graph X of FIG. 4, the maximum traction force between the ropes 14 and sheave 12 is developed at the mid-point C between the take-up and take-off positions A and B. For the configuration shown in FIG. 1, this mid-point C corresponds to top dead center (TDC) for the sheave 12. The total amount of traction force between the ropes 14 and the sheave 12 is the area under curve X in FIG. 4. Therefore, in order to ensure there is adequate traction to drive the elevator system 10, the mass of the car 16 and the counterweight 18 must be maintained at an adequate level. This fact limits the use of lightweight components in the elevator system 10. In addition, the wear of the ropes 14 is dependant in part upon the maximum force on the ropes 14, which increases with any increases in the tension. Therefore, increasing the load of the car 16 and counterweight 18 to ensure adequate traction also increases the maximum forces at the mid-point C, and thereby the wear of the ropes 14.

Figure 2:
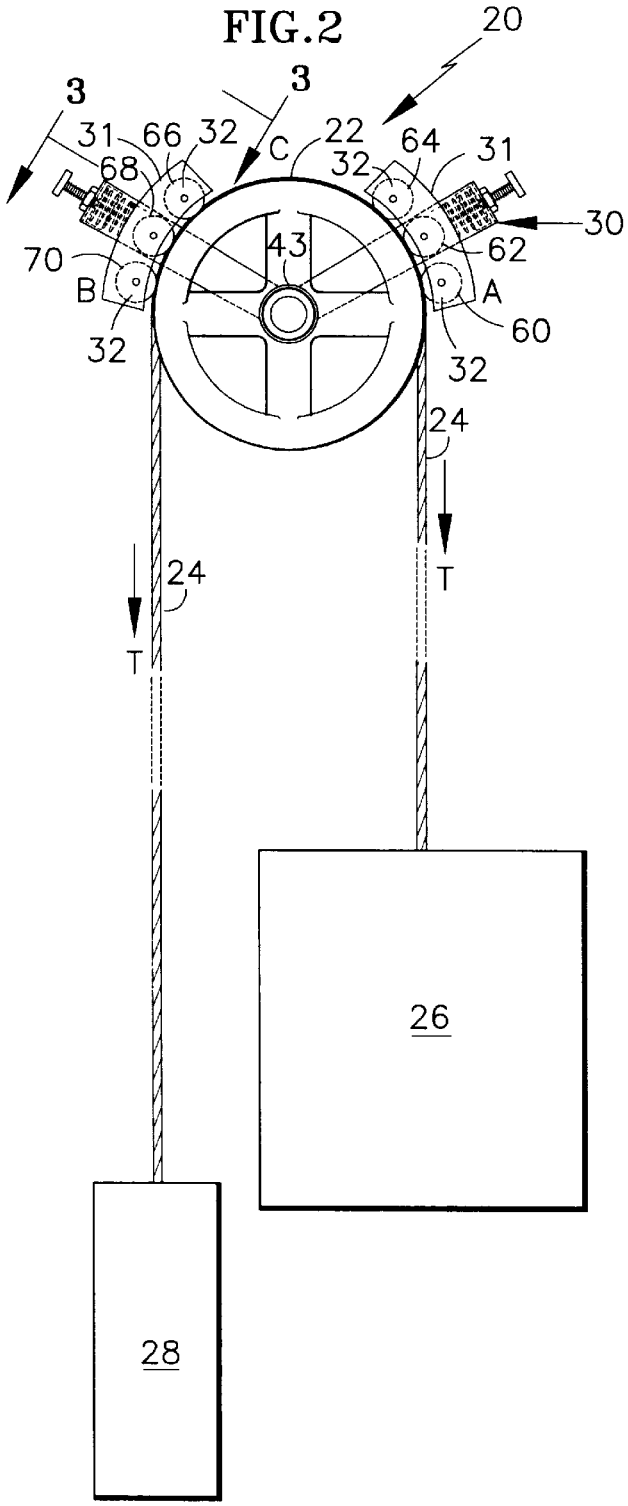
FIG. 2 is a side view of a traction drive elevator system according to the present invention.
Figure 3:
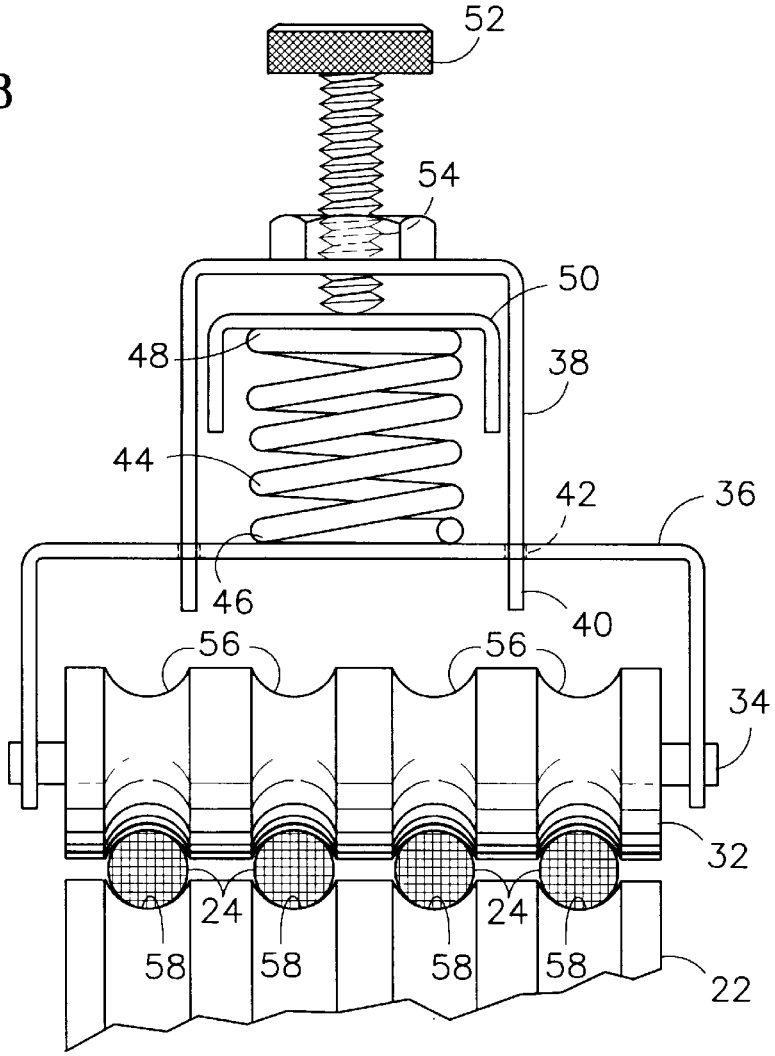
FIG. 3 is a view taken along line 3—3 of FIG. 2.

A traction drive system 20 according to the present invention is illustrated in FIGS. 2 and 3. The traction drive system 20 includes a traction sheave 22 engaged with a machine (not shown) and with one or more ropes 24. Rotation of the sheave 22 moves the ropes 24 and, thereby, moves a car 26 and counterweight 28. The traction drive system 20 also includes means 30 to enhance the traction forces between the ropes 24 and the contact surfaces of the traction sheave 22.

The means 30 includes a pair of devices 31 located about the periphery of the traction sheave 22. Each device 31 is located proximate to the take-up/take-off points of the traction sheave 22 and extend over a portion of the periphery toward top dead center of the traction sheave 22.

Each device 31 includes three rollers 32, each having an axle 34 mounted in a carrier 36 in a manner permitting rotation of the roller 32 and axle 34. The carrier 36 is retained to a frame 38 by a pair of extensions 40 that engage a pair of apertures 42 in the carrier 36. The configuration of the extensions 40 and apertures 42 results in a slotted engagement between the frame 38 and the carrier 36 to permit relative movement between the frame 38 and carrier 36 while blocking movement of the carrier 36 about the periphery of the traction sheave 22 during engagement with the moving ropes 24. The frame 38 is held immobile by being fastened to the non-rotating base 43 of the traction sheave 22.

Disposed between the frame 38 and carrier 36 is a helical spring 44 that has one end 46 in contact with the carrier 36 and the opposite end 48 disposed within a seat 50. The seat 50 includes an adjustment screw 52 and is positioned relative to the frame 38 by the threaded engagement between the adjustment screw 52 and a threaded aperture 54 in the frame 38. The spring 44 defines means to bias the ropes 24 against the contact surface of the traction sheave 22 and provides the benefit of accommodating variations in the diameter of the ropes 24. Although a helical spring 44 is shown, other types of springs may be used in place of the helical springs 44 and, in addition, other types of devices may be used to apply a radially inward force on the ropes 24.

Each of the rollers 32 extends across the grooved face of the sheave 22 and includes a plurality of complementary grooves 56. The grooves 56 are shaped to accommodate rolling contact with one of the ropes 24 and each of the grooves 56 is positioned to be opposite to one of the grooves 58 of the sheave 22. In this way, each rope 24 is pressed between the rollers 32 and the sheave 22. Although shown as a single roller 32 extending across the grooves 58 the sheave 22, it should be apparent to those skilled in the art that multiple rollers may be used to extend across the grooves 58, as desired.

The magnitude of the pressure applied to the ropes 24 is dependant upon the adjustment of the spring 44. Rotation of the adjustment screw 52 in a first direction reduces the separation between the seat 50 and the carrier 36, and thereby results in further compression of the spring 44. Radially inward movement of the carrier 36 due to the increased spring 44 force is blocked by the engagement of the rollers 32 with the ropes 24.

During operation of the elevator system, as the ropes 24 reach the take-up point A they are squeezed between the grooves 56 of the first roller 60 and the grooves 58 of the traction sheave 22. The additional pressure applied by the roller 60 increases the traction force between the ropes 24 and the traction sheave 22 in this region. As the ropes 24 move around the periphery of the traction sheave 22, they are engaged by the second roller 62 and the third roller 64. Each of these rollers 62,64 applies pressure to the ropes 24 to increase the traction force. In addition, the tension T in the ropes 24 caused by the mass of the car 26 and counterweight 28 increasingly contributes to the traction force. As the ropes 24 move past the third roller 64, the magnitude of the traction force is dependant upon the tension T until the ropes 24 reach the first roller 66 of the opposite device 31. At this point, the magnitude of the traction force is the cumulative effect of the tension T and the pressure applied by the roller 66 and the next two rollers 68,70. The last roller 70 is proximate to the take-off point B where the ropes 24 disengage from the traction sheave 22.

The resulting magnitude of the traction force as a function of the position of the rope 24 on the sheave 22 is shown in an exemplary graphical display as curve Y in FIG. 4. Relative to curve X of FIG. 4, it can be seen that the means 30 to enhance the traction force between the ropes 24 and the traction sheave 22 results in a more uniform distribution of the traction forces. The advantage of the more uniform distribution is that the maximum traction force may be reduced without reducing the total traction force. This feature minimizes the wear of the ropes 24 and permits the mass of the car 26 and counterweight 28 to be reduced since the traction force is not solely dependant upon the tension T in the ropes 24.

Figure 5:
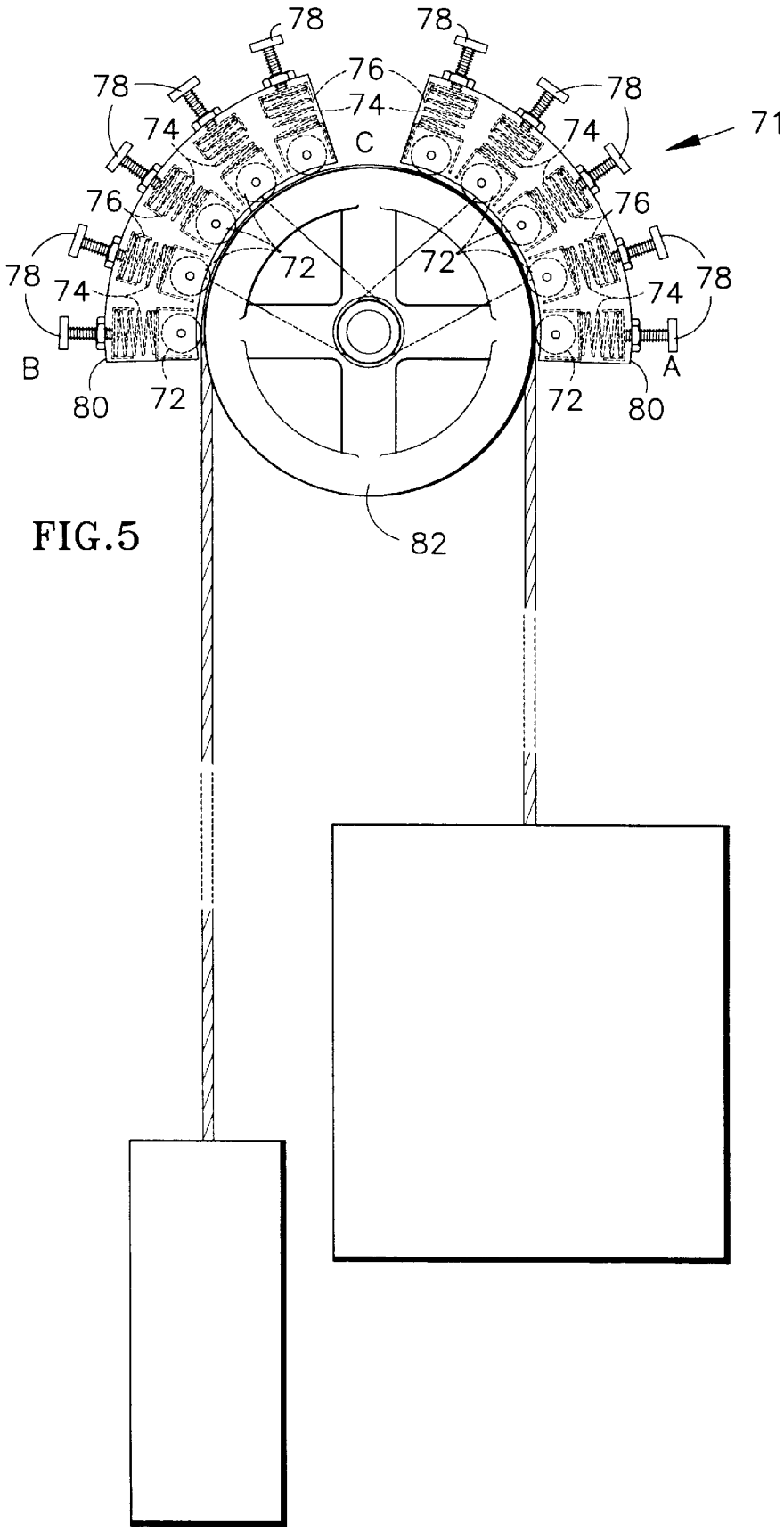
FIG. 5 is a side view of an alternate embodiment of the present invention.

An alternate embodiment 71 of the present invention is illustrated in FIG. 5. In this embodiment, each roller 72 is associated with an individual spring 74 having its own seat 76 and adjustment screw 78 engaged with a frame 80. In addition, the number of rollers 72 is increased from three to five and the rollers 72 extend further about the periphery of the traction sheave 82. The operation of this embodiment is similar to the configuration shown in FIGS. 2 and 3, except that each spring 74 may be individually adjusted to permit variations in the amount of spring force on each roller 72 as a function of circumferential position. For instance, the maximum spring force may be applied to the rollers 72 proximate to the take-up and take-off points A and B, with decreasing spring forces applied to the rollers 72 as they get closer to top dead center. This fine tuning of the spring forces may be used to improve the uniformity of the distribution of traction forces, such as shown in curve Z in FIG. 5, or to provide other variations on the distribution of traction forces.

Although the invention has been shown and described with respect to exemplary embodiments thereof, it should be understood by those skilled in the art that various changes, omissions, and additions may be made thereto, without departing from the spirit and scope of the invention.

What is claimed is:

1. A traction drive elevator system, the elevator system including a car disposed for movement within a hoistway, a counterweight for movement within the hoistway, one or more traction ropes engaged with the car and counterweight, and a traction drive engaged with the ropes, the traction drive including:

a traction sheave having one or more grooves to receive the ropes, each groove having a contact surface that engages the ropes to define means to transfer traction forces to the ropes, wherein the traction forces are defined in part by the tension in the ropes caused by the mass loading of the car and counterweight; and means to enhance the traction forces between the ropes and the contact surfaces, the enhancement means increasing the contact pressure between the ropes and the contact surfaces over at least a portion of the contact surface, such that the resulting traction forces include the sum of the traction forces caused by the tension in the ropes and the traction forces caused by the enhancement means, and wherein the increase in contact pressure caused by the enhancement means is dependent upon circumferential location, such that a predetermined distribution of contact pressure is produced.

2. The traction drive elevator system according to claim 1, wherein the enhancement means includes means to bias the ropes against the contact surface.

3. The traction drive elevator system according to claim 2, wherein the biasing means is a spring that urges the ropes against the contact surface.

4. The traction drive elevator system according to claim 1, wherein the engagement between the ropes and the traction sheave includes a take-up position, and wherein the enhancement means is disposed to increase the contact pressure in the portion of the contact surface proximate to the take-up position.

5. The traction drive elevator system according to claim 1, wherein the engagement between the ropes and the traction sheave includes a take-off position, and wherein the enhancement means is disposed to increase the contact pressure in the portion of the contact surface proximate to the take-off position.

6. The traction drive elevator system according to claim 4, wherein the engagement between the ropes and the traction sheave includes a take-off position, and wherein the traction drive includes a second enhancement means disposed to increase the contact pressure in the portion of the contact surface proximate to the take-off position.

7. The traction drive elevator system according to claim 1, the enhancement means including a frame, a biasing means seated within the frame, and a plurality of rollers mounted within a carrier in a manner permitting rotation of the rollers, the plurality of rollers spaced circumferentially about the traction sheave grooves, wherein the biasing means is engaged with the carrier to bias the carrier and the rollers towards the contact surfaces, and wherein the ropes are engaged with the rollers such that the rollers increase the contact pressure between the ropes and the contact surface.

8. The traction drive elevator system according to claim 7, wherein the frame includes an adjustment screw that permits adjustment of the forces applied to the carrier by the biasing means.

9. The traction drive elevator system according to claim 7, wherein the force applied by each roller to the ropes is dependent upon the circumferential position of the roller relative to the traction sheave, such that the predetermined distribution of contact pressure is produced.

10. The traction drive elevator system according to claim 9, wherein the predetermined distribution of contact pressure approximates a uniform distribution over the contact surfaces.

* * * * *